US006615439B1

(12) United States Patent
Thurnher

(10) Patent No.: US 6,615,439 B1
(45) Date of Patent: Sep. 9, 2003

(54) CLEANING DEVICE FOR THE WINGS OF SLIDING WINDOWS OR DOORS

(76) Inventor: Julius Thurnher, Friedrich Schlöglgasse 4, A-3002 Purkersdorf (AT)

( * ) Notice: Subject to any disclaimer, the term of this patent is extended or adjusted under 35 U.S.C. 154(b) by 0 days.

(21) Appl. No.: 09/786,773

(22) PCT Filed: Sep. 8, 1999

(86) PCT No.: PCT/AT99/00218

§ 371 (c)(1),
(2), (4) Date: Jun. 25, 2001

(87) PCT Pub. No.: WO00/15092

PCT Pub. Date: Mar. 23, 2000

(30) Foreign Application Priority Data

Sep. 10, 1998 (AT) ..... 1533/98

(51) Int. Cl.[7] ..... B60S 1/56; A47L 1/00

(52) U.S. Cl. ..... 15/250.04; 15/103; 15/250.11; 15/250.1

(58) Field of Search ..... 15/250.1, 103, 15/250.04, 250.01, 250.41, 250.29, 250.11, 97.1

(56) References Cited

U.S. PATENT DOCUMENTS

| | | | | | |
|---|---|---|---|---|---|
| 1,030,546 | A | * | 6/1912 | Sharkey | 15/250.1 |
| 1,120,094 | A | * | 12/1914 | Shipley | 15/250.1 |
| 1,798,215 | A | * | 3/1931 | Neilson | 15/103 |
| 1,804,867 | A | | 5/1931 | Fisher | 15/250.1 |
| 1,840,201 | A | * | 1/1932 | Keller | 15/250.1 |
| 1,924,922 | A | * | 8/1933 | Gehrig | 15/250.1 |
| 3,048,871 | A | * | 8/1962 | Presser | 15/250.19 |
| 3,104,411 | A | | 9/1963 | Presser | 15/250.1 |
| 3,378,875 | A | * | 4/1968 | Kern | 15/250.04 |
| 3,548,440 | A | * | 12/1970 | Kothari | 15/250.1 |
| 4,809,384 | A | | 3/1989 | Yokota et al. | 15/103 |

FOREIGN PATENT DOCUMENTS

| | | |
|---|---|---|
| AT | 390 473 | 5/1990 |
| DE | 24 36 171 | 2/1975 |
| EP | 0 709 054 | 5/1996 |

* cited by examiner

*Primary Examiner*—Gary K. Graham
(74) *Attorney, Agent, or Firm*—Collard & Roe, P.C.

(57) ABSTRACT

A cleaning device for the wings (1, 2) of sliding windows or doors which overlap each other by their front ends in the closed position and which have edge sections (4, 7, 8, 11; 4', 7', 8', 11') embracing a glasswork (3, 3'), with at least the outer wing (1) being configured as a sliding wing mounted to be displaceable in a stationary framework (5) on the front-side edge section (4), facing the inner wing (2), as well as stationarily on the stationary framework (5) on the outer side of the outer sliding wing (1) close to the front side thereof, if the latter is in the closed position, facing the outer sliding wing (1), a respective cleaning ledge (18, 26) is attached which comprises at least one wiper ledge (19, 20) of a length corresponding to the height of the glasswork (3; 3') of the associated wing (2, 1) as well as a cleaning liquid duct (24) connected to a supply duct (27, 28); each cleaning liquid duct (24) is connected with a pump (29) arranged in the stationary framework (5) via a supply duct (27, 28) extending in the stationary framework (5) and is configured with spray openings (25) distributed over the longitudinal extension of the ledge (18, 26) corresponding to the height of the glasswork (3, 3'), and the supply duct (27) which is connected with the cleaning ledge (18) on the outer sliding wing (1) is formed by a hose comprising an additional length (30) housed in the stationary framework (5).

21 Claims, 3 Drawing Sheets

CLEANING DEVICE FOR THE WINGS OF SLIDING WINDOWS OR DOORS

CROSS REFERENCE TO RELATED APPLICATIONS

This application is a 371 of PCT/AT99/00218 filed on Sep. 8, 1999, which claims priority to Austrian application A1533/98 filed on Sep. 10, 1998.

The invention relates to a cleaning device for the wings of sliding windows or doors which comprise at least two wings, an inner and an outer one, overlapping each other by their front ends in the closed position, and which have edge sections embracing a glasswork of the wings, with at least the outer wing being configured as a sliding wing mounted to be displaceable in a stationary framework, and with a respective cleaning ledge being attached at the front-end edge section facing the inner wing, as well as stationarily on the stationary framework on the outer side of the outer sliding wing close to the front end thereof, if the latter is in the closed position, facing the outer sliding wing, each cleaning ledge comprising at least one wiper ledge of a length corresponding to the height of the glasswork of the associated wing as well as a cleaning liquid duct connected to a supply duct.

To clean the external sides of fixedly installed windows which cannot be opened in modern buildings, various automatic cleaning devices have already been suggested, cf. e.g. EP-A-709 054 as well as U.S. Pat. No. 4,809,384. In this instance, special section rails must be provided in the region of the stationary framework which in addition to fastening the glass panes, support an undercarriage for movable cleaning devices which comprise the elements required for cleaning the glass panes, such as spray nozzles and wiper blades, yet also a motor drive and a pump for the cleaning liquid (commonly water). These known cleaning devices thus are extremely complex and complicated as regards their construction and also require a lot of space so that they are quite conspicuous on the facades of buildings and negatively affect their appearance.

The known cleaning devices moreover are hardly suitable for cleaning the glasswork of the wings of sliding windows or also of sliding doors, since sliding windows or doors comprise wings offset relative to each other in depth which are arranged according to planes parallel to each other and overlap each other in the closed position. Thus, one cleaning device would have to be provided per wing, since the known cleaning devices are not suitable for a sufficient adjustment in depth, i.e. transversely to the plane of the sliding wings, so that one cleaning device after installation can only be associated to one wing Furthermore, from U.S. Pat. No. 3,104,411A a window with two displaceable wings and with a cleaning device of the initially defined type is known. This, however, is a cleaning device to be operated manually, in which water is supplied via filling funnels with the assistance of an external hose or the like to a cleaning ledge with water outflow openings. Accordingly, there is no permanent water supply, and the supplied water is unpressurized so that merely insufficient cleaning of the window wings is possible, apart from the cumbersome handling.

The invention has as its object to provide a cleaning device of the initially defined type which allows for an automatic, reliable and effective cleaning of the glasswork of the wings of the sliding windows or doors, respectively, in a simple manner, wherein the construction is to be as simple as possible and, moreover, inconspicuous so that the appearance of the sliding windows or doors, respectively, practically is not adversely affected.

The inventive sliding wing cleaning device of the initially defined type is characterised in that each cleaning liquid duct is connected with a pump arranged in the stationary framework via a supply duct extending in the stationary framework and is configured with spray openings distributed over the longitudinal extension of the ledge corresponding to the height of the glasswork, and that the supply duct which is connected with the cleaning ledge on the displaceable, outer sliding wing is formed by a hose comprising an additional length housed in the stationary framework.

With such a design, the object set out above is met in an advantageous manner, and a cleaning device is created which merges extremely inconspicuously in the appearance of the respective sliding window or sliding door. If the wings of the sliding windows or sliding doors are shifted horizontally relative to each other, this shifting movement simultaneously is utilised for the relative movement between cleaning elements and glasswork required during cleaning. In this manner, one cleaning unit, i.e. a cleaning ledge with cleaning liquid duct and spray openings, is arranged to be movable, and this simply by being mounted in the front end region of the displaceable outer sliding wing. The cleaning ledge associated to this outer sliding wing, however, may be stationarily attached to the stationary framework, cleaning of the glasswork of the outer sliding wing being realized during shifting of the outer sliding wing relative to the stationary cleaning ledge. In the closed state of the sliding window or door, the two cleaning ledges—which both maybe relatively narrow and thus extremely inconspicuous—are located in the region of the front end of the outer sliding wing, where the glass pane is embraced in a vertical edge section in the usual manner so that the two cleaning ledges optically are not apparent. The remaining parts of the cleaning device, such as, in particular, the pump with associated motor, as well as the supply ducts may be stationarily housed within the stationary framework so that they remain invisible and thus cannot negatively affect the appearance of the sliding window or door either. The entire construction is also comparatively simple because only a few movable parts are present, and these do not require a separate movable undercarriage or the like, but may directly be mounted to the one, movable sliding wing. The wings as such may be displaced manually, yet it is also possible to provide a motor drive for at least one wing, e.g. the inner wing, for displacing the same, cf. e.g. DE 24 36 171 A. With a sliding wing motor drive a completely automatic cleaning of the wings can be attained during motor-caused displacement, and optionally also a computer control may be provided therefor. By the fact that the supply line connected with the cleaning ledge on the displaceable outer window wing is formed by a hose with an additional length housed in the stationary framework, the present cleaning device additionally is also suitable for longer displacement distances (and thus for larger sliding wings), and in this manner moreover an optically pleasing appearance can be ensured. Thus, a flexible hose connects the cleaning liquid duct of the cleaning ledge attached to the movable sliding wing with the pump within the stationary framework, the hose with its additional length providing for a compensation for the movement stroke of the sliding wing. The additional length may as such be provided by a small hose drum having a resiliently biased drum core which thereby will rotate automatically in the sense of reeling up, similar to a cable drum, so that the hose will always be held reeled up and tensioned, respectively. However, with sliding wings of larger dimensions, even if hoses may have comparatively small cross-sections—in the range of a few millimeters—this may result in such a large drum diameter (including the hose) that when housing the same in the stationary framework, oversized frame parts of the stationary framework will be required for accommodating the hose drum. On the other hand, it has also proven advantageous if the additional hose length is formed by a variable hose loop. To keep the hose loop tensioned and thus to ensure a proper drawing out or pulling in of the hose while the sliding wing is being shifted, it is furthermore advantageous if the hose loop is formed with a resiliently held hose pulley adjustable for shortening the loop against the spring force. In this embodiment, thus, the resilient hose roll ensures in the manner of a compensating roller that the hose always will be held under a certain tension and thus will take a proper course.

It has furthermore proven suitable if the supply duct connected with the duct of the cleaning ledge stationarily attached on the stationary framework is formed by a hose fixedly arranged in the stationary framework. Even if this supply duct thus may be fixed as regards its length, mounting thereof will be facilitated if it is formed by a hose, since usually the stationary framework parts are formed by section portions with closed compartments, in which case the hoses may simply be mounted into these sections.

To provide for the possibility of optionally also cleaning only one of the wings in a simple manner, it is moreover suitable if a locking member is arranged in at least one of the supply ducts, e.g. in the supply duct to the stationary cleaning ledge.

The pump may be connected via an appropriate suction or feed duct with a container for the cleaning liquid provided at any desired location; in particular, it is conceivable to provide a central container for several adjacently arranged sliding windows. However, to design each sliding window or each sliding door, respectively, autonomously, wherein the cleaning device practically should be integrated in the construction of the sliding window or sliding door, respectively, it is advantageous if the pump is connected with a cleaning liquid container provided in the lower frame part of the stationary framework via a feed duct. With a view to a space-saving configuration with a sufficiently large volume it is, furthermore, suitable if the elongate, e.g. box-section-type container extends substantially over the entire length of the lower frame part of the stationary framework. It is also advantageous if at least one inlet opening for supplying driving rain, condensation water or the like as well as for refilling cleaning liquid, in particular water, is associated to the container in an upper delimiting wall. Through the inlet opening possibly forming condensation water or driving rain thus can be utilized, and moreover, the required cleaning liquid, i.e. water, optionally additionally also cleaning agent as well as anti-freezing agent, can be filled into the container in a simple manner. To facilitate supplying the water etc., it is furthermore suitable if the inlet opening is arranged in deepened positions between upwardly projecting section webs of the lower frame part of the stationary framework. The upwardly projecting section webs may act like the walls of a funnel to thus facilitate filling of the container.

An advantageous embodiment is also characterised in that an overflow duct is connected to the container and extends to the outer side of the stationary framework so as to conduct away overflowing cleaning liquid. In this manner, water in excess may be drained on the outer side of the building, on the outer facade. In this respect it is suitable for a simple and hidden arrangement of the overflow duct if the overflow duct is arranged on the lower side of an outer window sill provided in a manner known per se.

An efficient, narrow configuration of the cleaning ledges can be achieved if each cleaning ledge is formed by a one-piece plastics or rubber section retained in a rigid fastening section and comprising a longitudinal channel forming the cleaning liquid duct which is transversely followed by the spray openings, as well as with the at least one wiper ledge for permanent abutment on the glasswork of the associated wing. In this respect it is furthermore advantageous if two wiper ledges are provided in the form of legs projecting, when seen in cross-section, U-like from a web which contains the channel. With this more or less symmetrical arrangement of the wiper ledges it can always be attained—irrespective of the direction of movement of the sliding wings—that the one wiper ledge carries out a pre-cleaning and the other wiper ledge then causes the pane to be wiped dry, i.e. the cleaning liquid sprayed out between the wiper ledges is wiped off. On the other hand, it is often suitable if a single wiper ledge is moulded to a channel-containing web in a manner laterally offset relative to the channel. With this design the individual wiper ledge can effect dry pre-cleaning of the glass pane during a forward stroke of the sliding wing, and immediately therebehind the cleaning liquid is sprayed from the channel through the spray openings. During the rearward stroke of the sliding wing, this liquid will be collected by the wiper ledge and wiped off, so that the glass pane or glasswork, respectively, will be dried. For a lateral excursion of the wiper ledge during the cleaning procedure it is also suitable if the wiper ledge follows the web via a connecting part which is thin as compared to the remaining wiper ledge.

For reliable wetting and cleaning of the glasswork it has proven suitable if the spray openings are arranged spaced from each other in cm-range, e.g. at intervals of from 1 to 4 cm. For this purpose it is also suitable if the spray openings are arranged more closely to each other in the upper glasswork region than in the lower region thereof. Moreover, it is advantageous if the spray openings have a.diameter in the range of tenths of a millimeter, e.g. 0.1 to 0.3 mm.

To supply the spray openings with cleaning liquid or water, respectively, it has proven to be sufficient if the ducts of the cleaning ledges have a round cross-section having a diameter in the range of mms, e.g. from 2 to 4 mms, in particular 3 mm.

The invention will be explained in more detail by way of the preferred exemplary embodiments illustrated in the drawings to which, however, it shall not be restricted. In the drawings, FIG. 1 shows a schematical view of a sliding window comprising two sliding wings and an associated cleaning device having two cleaning ledges;

Figure 1:
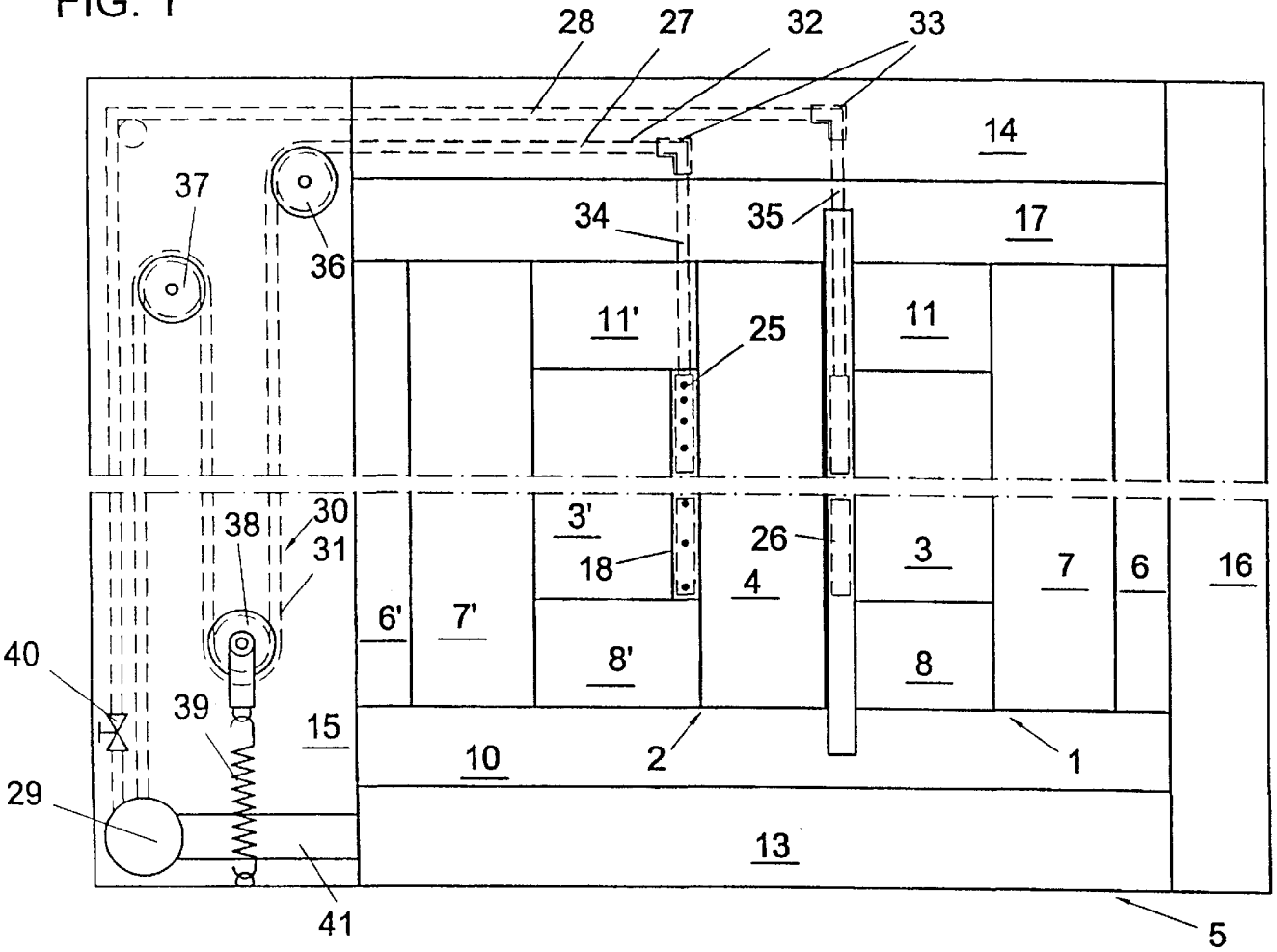
Figures 2, 4:
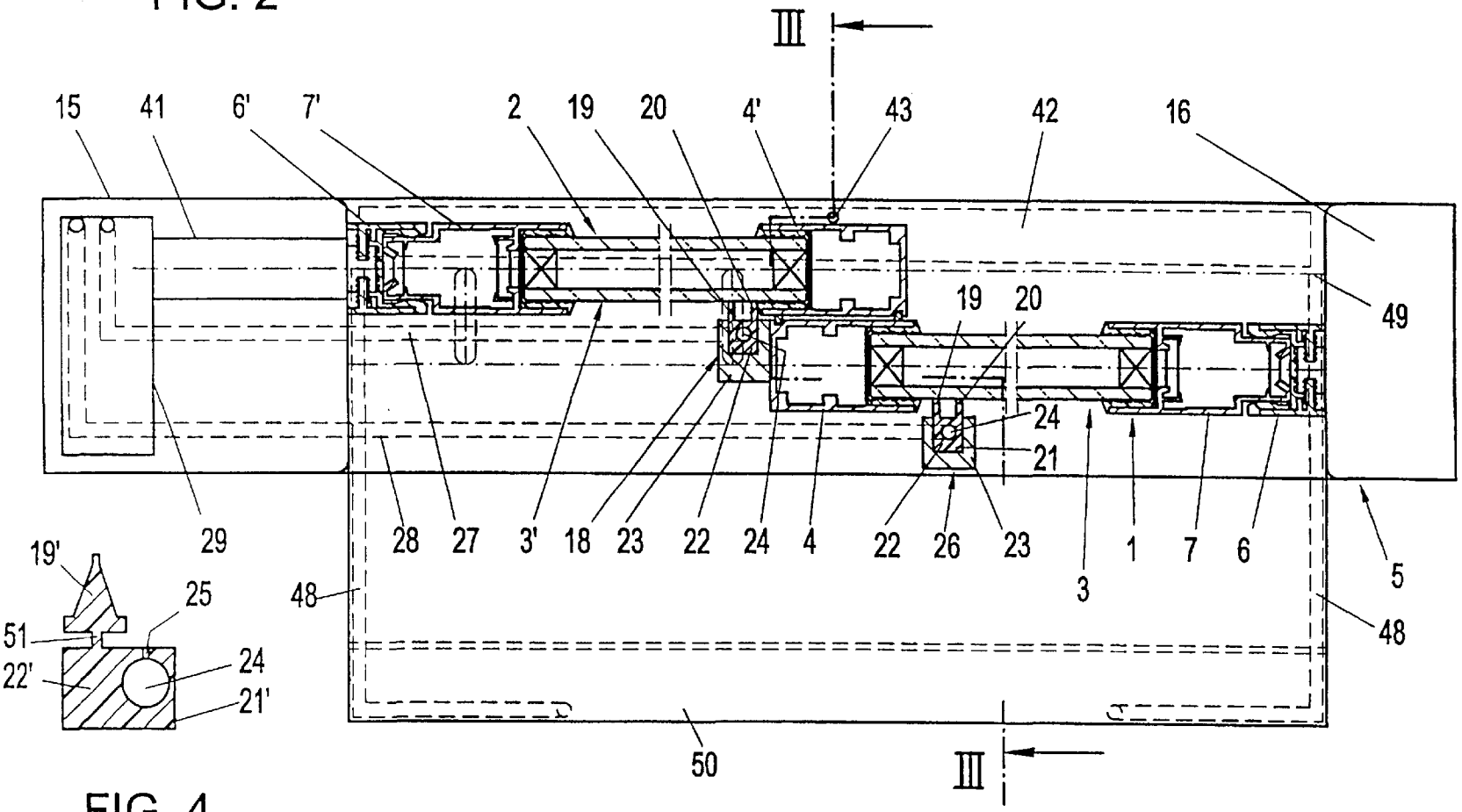
FIG. 2 shows a schematical horizontal section through such a sliding window.
FIG. 4 shows a cross-section through a plastics section for a modified cleaning ledge.
Figure 3:
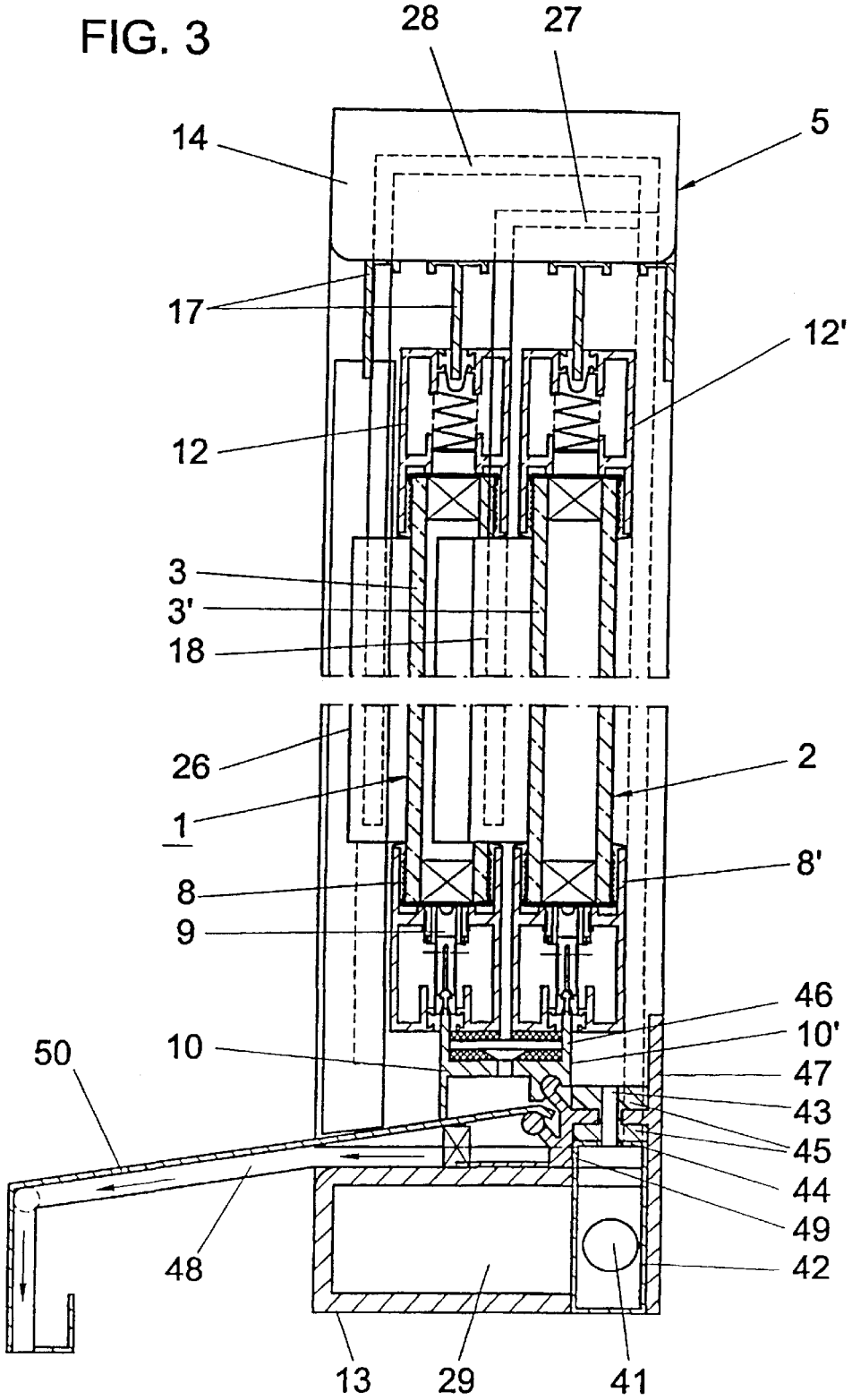
FIG. 3 shows an associated vertical section, approximately according to line III—III of FIG. 2.

In FIGS. 1 to 3, a sliding window comprising two sliding wings 1, 2 is schematically illustrated, the basic construction of which is known per se, cf., e.g., AT 390 473 B. Thus, a detailed description of the construction of the sliding window is not required, and it suffices to mention that each sliding wing 1, 2 includes glasswork 3 and 3', respectively, mounted in embracing edge sections; for instance, the sliding wing 1 which is the outer one in the sliding window illustrated has a front-end, vertical edge section 4, a rear, vertical edge section 7 which in the closed position is located more closely to the stationary framework 5 or to a vertical frame section 6 mounted there, a lower edge section 8 which is provided with running rollers 9 (cf. FIG. 3) for displacement on a lower frame section 10, as well as an upper edge section 11.

Correspondingly, the inner sliding wing 2 which is located more closely to the room closed by the window comprises a middle, vertical edge section 4', cf. FIG. 2 (in FIG. 1, this edge section 4' is hidden by the corresponding middle edge section 4 of the outer sliding wing 1, as can be seen from FIG. 2), a lower, horizontal edge section 8', a stationary-framework-side edge section 7' and an upper horizontal edge section 11'. In the upper central corner regions, the two sliding wings 1, 2 are provided, e.g., with-sealing caps 12, 12' illustrated in section in FIG. 3, which may be displaced upwardly in telescope manner, and inwardly against a spring force. For one or both of the sliding wings 1, 2, also a motor drive may be provided which, however, is not illustrated in the drawing. On the other hand, it is also conceivable to fixedly attach the inner wing 2 and to merely design the outer wing 1 as a displaceable sliding wing. This sliding wing 1 may, of course, also be manually displaced.

The glasswork 3, 3' may be simple panes of glass, preferably, however, they are provided as insulating or multipane glass.

The stationary framework 5 is composed of a lower, horizontal frame part 13, an upper, horizontal frame part 14, a wider, vertical, frame part 15 which is the left-hand frame part according to the illustration of FIG. 1, as well as an oppositely arranged right-hand vertical frame part 16. These frame parts 13, 14, 15, 16 are, e.g., formed by hollow sections, and the already mentioned frame sections 6, 10 as well as 6' and upper section 17 (cf. FIG. 1) which serve for guiding and sealing the sliding wings 1, 2 are fastened thereto.

In the illustrations according to FIGS. 1 and 2, the two sliding wings 1, 2 overlap each other in the middle, the edge sections 4, 4' being provided adjacent each other or—as viewed through the window—one behind the other. On the front end of the edge section 4 of the outer sliding wing 1, a cleaning ledge 18 is provided which extends over the height of the glasswork 3' of the inner sliding wing 2 and, in the closed position of the two sliding wings 1, 2 illustrated and because of its front-end attachment on the outer sliding wing 1, abuts on the rim of the glasswork 3' of the inner sliding wing 2 immediately adjacent its vertical edge section 4'. In detail, two wiper ledges 19, 20 of a rubber or plastics section 21 abut, which rubber or plastics section 21 is seated in a metal fastening section 23 with its body or web 22 proper, e.g. is pressed thereinto. The fastening section 23 is fixedly mounted on the front side of the edge section 4 of the outer sliding wing 1, e.g. by being screwed or also glued thereto. A cleaning liquid duct 24 in the form of a longitudinal channel or a longitudinal bore is provided in the web 22 of the plastics or rubber section 21 which has a generally U-shaped cross-section, and seen in top view according to FIG. 2, the two wiper ledges 19, 20 are symmetrically arranged relative to this cleaning liquid duct 24 on either side of the central plane thereof, corresponding to the legs of the "U" formed in cross-section. Between the two wiper ledges 19, 20, spray holes are vertically superimposed in this web 22, these spray holes being schematically indicated at 25 in FIG. 1.

A corresponding cleaning ledge 26 is stationarily arranged on the stationary framework 5, i.e., in detail, on the frame sections 10 and 17, respectively, fastened to the lower and upper frame parts 13 and 14, respectively, as can best be seen in FIG. 1. Also this stationary cleaning ledge 26 associated to the outer sliding wing 1 is arranged such that it abuts on the rim of the glasswork 3 of the associated sliding wing 1 in the closed position of the window, as can be seen from FIGS. 1 and 2. In turn, it has a metal fastening section 23, into which an equally configured plastics or rubber section 21 is pressed which has two wiper ledges 19, 20 on a web 22; in the web 22, again a longitudinal bore or a longitudinal channel is provided as cleaning liquid duct 24. Again, superimposed spray holes (not illustrated in detail) are provided according to a vertical line on the web 22 between the two wiper ledges 19, 20.

The cleaning liquid ducts 24 of the two cleaning ledges 18, 26 are connected via supply ducts 27 and 28, respectively, with a pump 29 stationarily arranged in the wide vertical frame part 15, these supply ducts 27 and 28, respectively extending in the upper frame part 14 of the stationary framework as well as furthermore in the vertical, wide frame part 15. The supply duct 28 connected to the stationary cleaning ledge 26 may be stationarily attached, whereas the supply duct 27 for the movable cleaning ledge 18 is designed as a hose with an additional length 30 in the form of a hose loop 31 in the interior of the vertical frame part 15 so as to allow for an associated movement of the upper portion 32 of the supply duct 27 within the upper frame part 14 when the outer sliding wing 1 together with the cleaning ledge 18 attached at the front end thereof is displaced. The cleaning ledges 18, 26, may be connected with the supply ducts 27, 28, which preferably are formed by flexible hoses, via rigid vertical duct portions 34 and 35, respectively, the supply ducts 27, 28 being connected with the vertical duct portions 34 and 35 via angles 33. It is, however, also conceivable to provide a hose at least in the case of the duct portion 35, since at that location there is no movement (with a force transmission onto the associated supply duct 28). The duct portions 34, 35 are guided through corresponding openings at the lower side of the upper frame part 14 of the stationary framework 5, and in the case of the movable cleaning ledge 18, the associated duct portion 34 extends through a slit opening, optionally with lip or brush sealing in abutment on the duct portion 34, which is not further illustrated in the drawing.

The hose loop 31 is formed between two stationary rolls 36, 37 and one movable, resiliently held hose roller 38 in the manner of a compensating roller, the movable hose roller 38 being pulled downward by a tension spring 39 so as to keep the hose loop 31 tensioned.

Furthermore, according to the illustration of FIG. 1, a locking member 40 is arranged in one supply duct, e.g. in supply duct 28, so as to optionally also allow for the cleaning of one sliding wing 2 only. It is, of course, possible and preferable to arrange a corresponding locking member also in the other supply duct 27, yet this is not further illustrated in the drawing.

Via a feed duct 41, the pump 29 is connected with a container 42 for cleaning liquid, in particular water, this container 42 being provided or designed in the lower frame part 13 of the stationary framework 5 in the form of an elongate box. The container 42 extends over the entire length of the lower frame part 13. The container 42 is located at the window inner side, as is apparent from FIGS. 2 and 3, and it is provided with an upper inlet opening 43 in an upper end wall 44. The inlet opening 43 may, e.g., be formed by a pipe piece sealingly inserted in sealing plastics strips 45 above the container 42 and ending with its upper end in the bottom of the frame section 10' for the inner sliding wing 2; the inlet opening 43 thus lies between upwardly projecting section webs 46, 47 (FIG. 3) which form a channel or a type of funnel for the inlet opening 43. In this manner, refilling cleaning liquid (water, detergents, anti-freezer) is facilitated just as the supply of possible condensation water or driving rain which might collect on the inner side of the window.

At the end sides, in the region of the two vertical frame parts 15, 16, a respective overflow duct 48 is connected to the container 42 externally on the upper container rim, at 49 (cf. FIG. 3), and these overflow ducts 48 extend on the lower side of a per se common window sill 50 (a window drip) so as to lead away overflowing water from the container 42 and allow it to drain 33 there. It should be noted that the window sill 50 has been omitted in the illustration of FIG. 1 for the sake of a better general view.

In FIG. 4, an embodiment of a section 21' which is modified as compared to the plastics or rubber section 21 for the cleaning ledges 18 and 26, respectively, shown in FIG. 2 is illustrated, the cleaning liquid duct 24 in this case again being arranged in a web or longitudinal body 22', offset from the middle thereof, and again in the form of a longitudinal channel or a longitudinal bore of round cross-section. Laterally offset thereto, an individual wiper ledge 19' is provided which is integrally connected with the web 22' via a comparatively thin connecting part 51, thereby ensuring a good movability of the wiper ledge 19' towards either side. With this embodiment of the section 21', a dry pre-cleaning of the respective glasswork 3 or 3', respectively, is obtained by the wiper ledge 19' when the outer sliding wing 1 is moved towards the left side according to the illustrations in FIGS. 1 and 2, and immediately therebehind the cleaning liquid from duct 24 is sprayed through the spray openings 25 onto the outer side of the glasswork 3 or 3', respectively. During the return stroke, i.e. during the movement of the outer sliding wing 1 towards the right side according to the illustrations of FIGS. 1 and 2, the spraying is stopped by turning off the pump 29, and the wiper ledge 19, then wipes over the glasswork 3 or 3', respectively, so as to wipe it dry.

Cleaning of the outer side of the glasswork 3' of the inner sliding wing 3 may, of course, also be carried out with a fixed outer sliding wing 1 in that the inner sliding wing 2 according to the illustrations of FIGS. 1 and 2 at first is moved towards the right side and then back again towards the left side into the starting or closed position shown, while the outer sliding wing 1 remains stationary in the closed position shown. Since the outer sliding wing 1 is not moved, in this instance the outer, stationary cleaning ledge would have to be turned off, i.e. the feed of cleaning liquid would have to be blocked with the assistance of a locking member 40 so as to avoid unnecessary spraying of water onto the stationary glasswork 3.

The cleaning liquid ducts 24 of the cleaning ledges 18, 26 or, more precisely, of the sections 21 and 21', respectively, preferably are circular in cross-section; the diameter may be in the range of a few millimeters, e.g. between 2 and 4 mm, preferably 3 mm. The actual cross-section naturally also correlates with the height of the glass surfaces to be cleaned and thus with the amount of cleaning liquid required. As schematically indicated in FIG. 1, the spray openings 25 may be spaced more closely from each other in the upper region than in the lower region so as to take into consideration that the cleaning liquid flows off from top to bottom on the outer side of the glass. The spray openings 25 themselves will have a cross-section or diameter in the range of tenths of a millimeter, the diameter may, e.g. be from 0.1 to 0.3 mm. The spaces between the spray openings 25 may, e.g., be from 1 to 4 cm.

Pump 29 may be driven with the assistance of an integrated direct current motor not further illustrated in the drawings, the entire motor-pump unit may have a cylindrical shape with a diameter of approximately 3 cm and a length of approximately 6 to 8 cm. Pump 29 and its motor, e.g. a 12V motor, may also be computer-controlled, which will be particularly advantageous if, as mentioned above, also a motor drive is provided for the sliding wings 1, 2 (or at least one of the sliding wings 1, 2).

What is claimed is:

1. A cleaning device for a closure mounted in a stationary framework, the closure comprising an inner wing and an outer wing, at least the outer wing being a slidable wing displaceable in the stationary framework between an open and a closed position, each wing having a front edge section, a rear edge section, an upper and lower edge section extending between the front and rear edge sections, and a glass embraced by the edge sections, the front edge sections of the wings overlapping in the closed position; a first cleaning ledge attached to the front edge section of the slidable wing and facing the inner wing, and a second cleaning ledge stationarily affixed to the stationary framework and facing an outer side of the slidable wing, the second cleaning ledge being positioned close to the front edge section of the slidable wing in the closed position, each cleaning ledge comprising at least one wiper ledge of a length corresponding to the distance between the upper and lower edge sections of the facing wing, the wiper ledges having spray openings distributed over the length thereof, and a cleaning liquid duct; and a supply duct connecting each cleaning liquid duct to a pump arranged in the stationary framework, the supply duct connecting the cleaning liquid duct of the first cleaning ledge to the pump being a hose having an excess length housed in the stationary framework.

2. A The cleaning device of claim 1, wherein the closure is a window.

3. The cleaning device of claim 1, wherein the closure is a door.

4. The cleaning device of claim 1, wherein the excess hose length forms a loop of variable length.

5. The cleaning device of claim 4, comprising a resiliently held roller about which the loop is guided, and a spring attached to the roller for adjusting the length of the loop under spring force.

6. The cleaning device of claim 1, wherein the supply duct connecting the cleaning liquid duct of the second cleaning ledge to the pump is a hose duct fixedly aranged in the stationary framework.

7. The cleaning device of claim 1, further comprising a shut-off valve arranged in at least one of the supply ducts.

8. The cleaning device of claim 1, wherein the stationary framework has a lower frame part, a cleaning liquid container is arranged in the lower frame part, and a feed duct connects the cleaning liquid container to the pump.

9. The cleaning device of claim 8, wherein the cleaning liquid container is an elongate box extending over the entire length of the lower frame part.

10. The cleaning device of claim 8, wherein an upper end wall of the lower frame part has at least one inlet opening for feeding liquid to the cleaning liquid container.

11. The cleaning device of claim 10, wherein the inlet opening is recessed between upwardly projecting webs of the lower frame part.

12. The cleaning device of claim 8, further comprising an overflow duct extending from the cleaning liquid container to an outer side of the stationary framework so as to remove overflowing cleaning liquid.

13. The cleaning device of claim 12, wherein the stationary framework comprises an outer window sill and the overflow duct is arranged in a lower side of the window sill.

14. The cleaning device of claim 1, wherein each cleaning ledge comprises a rigid fastening section retaining a one-piece section of a yielding material defining the cleaning liquid duct extending longitudinally along the at least one wiper ledge, the wiper ledge being in permanent wiping contact with the glass of the facing wing.

15. The cleaning device of claim 14, wherein the one-piece section of yielding material comprises a base web and two legs projecting from the base web, the legs forming two of said wiper ledges defining the cleaning liquid duct therebetween.

16. The cleaning device of claim 15, further comprising a thing connecting part connecting the wiper ledge to the base web.

17. The cleaning device of claim 14, wherein the one-piece section of yielding material comprises a base web defining the cleaning liquid duct, and the wiper ledge projects from the base web and is laterally offset relative to the cleaning liquid duct in the base web.

18. The cleaning device of claim 1, wherein the spray openings are spaced from each other at intervals of 1 cm to 4 cm.

19. The cleaning device of claim 1, wherein the spray openings are spaced more closely to each other in a region of the glass adjacent to the upper edge section than in a region of the glass adjacent the lower edge section.

20. The cleaning device of claim 1, wherein the spray openings have a diameter in the range of tenths of a millimeter.

21. The cleaning device of claim 1, wherein the cleaning liquid ducts have a round cross-section with a diameter in the range of millimeters.

* * * * *